United States Patent [19]

Kawamura

[11] Patent Number: 4,789,331

[45] Date of Patent: Dec. 6, 1988

[54] LIQUID FUEL BURNER

[75] Inventor: Hideo Kawamura, Fujisawa, Japan

[73] Assignee: Isuzu Motors Limited, Tokyo, Japan

[21] Appl. No.: 71,107

[22] Filed: Jul. 8, 1987

[30] Foreign Application Priority Data

Jul. 8, 1986 [JP] Japan ..... 61-158851

[51] Int. Cl.[4] ..... F23Q 7/08

[52] U.S. Cl. ..... 431/262; 431/261; 431/336; 431/352

[58] Field of Search ..... 431/262, 261, 336, 352, 431/328, 337; 126/110 C, 110 R, 116 R; 219/260, 267, 274, 275; 237/12.3 C, 32

[56] References Cited

U.S. PATENT DOCUMENTS

| | | | |
|---|---|---|---|
| 2,445,341 | 7/1948 | Trimble et al. | 431/262 X |
| 2,710,652 | 6/1955 | Ambrose | 431/262 X |
| 2,779,398 | 1/1957 | Brown | 431/262 X |
| 3,159,201 | 12/1964 | Hottenroth et al. | 431/261 X |
| 3,531,229 | 9/1970 | Berglund | 431/261 X |
| 4,476,378 | 10/1984 | Takizawa et al. | 431/262 X |
| 4,538,985 | 9/1985 | Zwicker | 431/262 |
| 4,582,980 | 4/1986 | Izzi | 431/262 X |

FOREIGN PATENT DOCUMENTS

| | | |
|---|---|---|
| 252018 | 12/1985 | Japan . |
| 61-79864 | 4/1986 | Japan . |
| 62-62107 | 3/1987 | Japan . |

*Primary Examiner*—Randall L. Green

*Attorney, Agent, or Firm*—Browdy and Neimark

[57] ABSTRACT

A burner comprises a fiber wick-filled atomizing chamber formed at an end of a combustion cylinder that constitutes a combustion chamber; a perforated ceramic disc provided in front of the atomizing chamber; and a heating plug that protrudes into the combustion chamber penetrating through the fiber wick and the ceramic disc. The heating plug is constituted by a heater bar composed of a ceramic material in which a heater coil is buried, in such a manner that a portion positioned in the atomizing chamber has a low temperature and an end protruded into the combustion chamber has a high temperature. The atomizing chamber, the combustion chamber and the combustion gas exhaust port are laterally arranged nearly in a horizontal direction, and a fuel feeding port is open at an upper portion of the atomizing chamber. Moreover, an air introducing path is formed between the combustion cylinder and an outer cylinder which surrounds the combustion cylinder.

6 Claims, 2 Drawing Sheets

PRIOR ART

LIQUID FUEL BURNER

BACKGROUND OF THE INVENTION

1. Field of the Invention

The present invention relates to a burner that can be adapted to indirect or direct heating apparatus and drying apparatus for use in a vehicle mounting an internal combustion engine or such a vehicle as a trailer, in a room of a house, in a drying room, and in an office.

2. Description of the Prior Art

In many cases, so far, the room in a vehicle is heated by taking out the cooling water of an internal combustion engine through a hot water pipe, introducing the water into a heater to indirectly exchange the heat, and blowing the hot air into the room. There has also been proposed a heating apparatus for automobiles for heating the room by the heat generated by a burner which is installed independently of the internal combustion engine (see Japanese Patent Laid-Open No. 252018/1985). There has further been proposed a device for warming the engine, in which the combustion gas of the burner is supplied to an intake port of the engine via a heat exchanger, and the air heated by the heat exchanger is guided into the room (see Japanese Patent Laid-Open No. 79864/1986). When the room is to be heated by utilizing the cooling water of the internal combustion engine, an extended period of time is required before the heater blows the hot air, since the temperature of the cooling water rises slowly. During this period, the heater exhibits almost no heating function. Further, the above-mentioned heating apparatus for automobiles that employs a burner independently of the internal combustion engine and the device for warming the engine require the time and laborious work for adjusting the period of combustion and treating the exhaust gases, and further require complex mechanism and a control device.

There has further been proposed a burner as disclosed in Japanese Patent Application No. 201856/1985 that was filed by the applicant of the present invention. This burner will be briefly described with reference to FIGS. 3, 4 and 5. FIG. 3 illustrates a burner 40 which has a fuel inlet groove 48 provided in the surface where a porous atomizing member 42 and a fuel heating plate 41 are superposed, the fuel inlet groove 48 communicating with a fuel inlet port 45. The burner 40 consists of a combustion cylinder 47 composed of a ceramic that is installed in a housing 46. An atomizing member 42 is arranged at an end of the combustion cylinder 47, and a combustion gas outlet port 49 is formed at the other end. The air for combustion is blown into a combustion chamber 50 through air inlet ports 52 as it is introduced from an air duct 51 via an air introducing path 54. A glow plug 44 for ignition is installed in the combustion chamber 50. With reference to FIG. 4, a heating wire 43 with terminals 53 is buried in the fuel heating plate 41. With reference to FIG. 5, a plurality of fuel inlet grooves 48 formed in the atomizing member 42 are extending from the fuel inlet port 45 that communicates with the fuel feeding pipe 55. This burner suppresses the unatomized fuel from staying in the atomizing member hat corresponds to the wick in order to prevent the eneration of white smoke when the combustion is scontinued, but leaves problems with regard to atomng the fuel, igniting the atomized fuel, preventing the flame from being blown out, and stability in the distribution of the flame.

SUMMARY OF THE INVENTION

The object of the present invention is to eliminate the above-mentioned problems, and provides a burner which atomizes the liquid fuel at a quick rate to form atomized fuel, and which ignites the atomized fuel to burn it, so that the effect of heating is obtained quickly.

Another object of the present invention is to provide a burner in which the atomizing and igniting mechanisms are simplified, the liquid fuel receives the heat sufficiently so as to be favorably atomized to form atomized fuel, a mixture consisting of the atomized fuel and the air for combustion is easily ignited to stabilize the flame, and the fuel is burned perfectly without permitting incomplete combustion or defective atomization to take place.

A further object of the present invention is to provide a burner which comprises a fiber wick-filled atomizing chamber formed at an end of a combustion cylinder that constitutes a combustion chamber; a perforated ceramic disc provided in front of the atomizing chamber; and a heating plug that protrudes into the combustion chamber penetrating through the fiber wick and the ceramic disc, wherein the liquid fuel is smoothly atomized, the mixture consisting of the atomized fuel and the air for combustion is reliably and quickly ignited without failure, the combustion is stabilized, the flame is not blown out, and the structure is very simplified.

Still further object of the present invention is to provide a burner in which the heating plug is constituted by a heater bar composed of a ceramic in which the heater coil is buried to exhibit functions as a glow plug for atomization and a glow plug for ignition, said heating plug being so constructed in such a manner that a portion located in the atomizing chamber has a low temperature and an end protruded into the combustion chamber has a high temperature, such that the temperature in the atomizing chamber is adjusted to be adapted to atomizing the liquid fuel and that the temperature in the combustion chamber is adjusted to be adapted to igniting and burning the mixture which consists of the atomized fuel and the air for combustion.

Yet further object of the present invention is to provide a burner in which the atomizing chamber, the combustion chamber and the combustion gas exhaust port are laterally arranged nearly in a horizontal direction, the fuel feed port is opened at an upper portion of the atomizing chamber, and the liquid fuel is reliably and quickly atomized as it flows down from the upper end of the atomizing chamber through the fiber wick.

A further object of the present invention is to provide a burner in which an air introducing path is formed between the combustion cylinder and an outer cylinder which is provided to surround it, the combustion air is introduced into the combustion chamber uniformly as it whirls through the air introducing path, the mixture is homogeneously formed and is ignited without failure and is burned, exhibiting the effect of heating apparatus quickly.

DETAILED DESCRIPTION OF THE EMBODIMENT

The burner according to an embodiment of the present invention will now be described in conjunction with FIG. 1.

Figure 1:
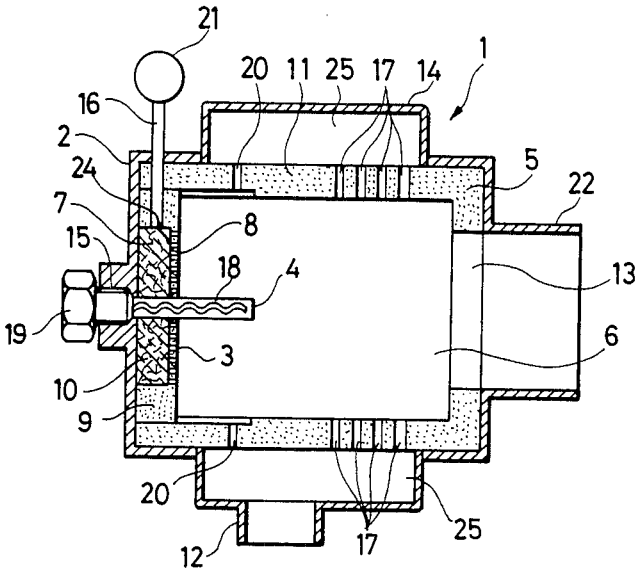
FIG. 1 is a section view illustrating a burner according to an embodiment of the present invention.

In FIG. 1, the burner according to the present invention is generally designated at 1. The burner 1 is of the wick type in which a combustion chamber 6 and an atomizing chamber 7 are provided in a combustion cylinder 11. The air is introduced via an air-intake pipe 12 from an air cleaner of a diesel engine or a gasoline engine, or from a separate air cleaner, or directly from the atmosphere or from the room. The combustion gas is directly blown into the room from a combustion gas exhaust port 13, or is sent into a heat exchanger (not shown) installed on the downstream side. When the combustion gas is to be sent into the heat exchanger installed on the downstream side, the heat exchanger may be installed in series with the burner 1 on the downstream side thereof or may be installed in the outer circumference of the burner 1.

The burner 1 consists of a combustion cylinder 11 and a metallic housing 14 which surrounds it. The combustion cylinder 11 is composed of a ceramic material having a small coefficient of thermal expansion. For instance, a dense ceramic or a ceramic material is made porous by using cordierite. The combustion cylinder 11 is laterally installed nearly in a horizontal direction, and an end wall 5 is formed at an end thereof, i.e. at the right end in the drawing. Further, a combustion gas exhaust port 13 is formed in the central portion of the end wall 5. Moreover, a combustion chamber 6 is constituted in the combustion cylinder 11, and an atomizing chamber 7 is constituted at an end of the combustion cylinder 11. Many air introducing holes 17, 20 are formed in the peripheral wall of the combustion cylinder 11. The air introducing holes 17 extend in the radial direction on the downstream side of the combustion chamber 6. The air introducing holes 20 are formed at positions close to the atomizer 2 in the combustion cylinder 11, i.e., formed in the combustion cylinder 11 at positions on the upstream side of the combustion chamber 6. The number of the air introducing holes 20 is smaller than the number of the air introducing holes 17. Therefore, the amount of the combustion air blown into the combustion chamber 6 through the air introducing holes 20 can be so adjusted that the atomized fuel and the combustion air are mixed well so as to be desirably ignited.

An air-intake pipe 12 made of a metal is provided at the side in a cylindrical portion of an outer housing 14, and an air introducing path 25 is formed between the combustion cylinder 11 and the outer housing 14.

The atomizing chamber 7 is constituted at an end of the combustion cylinder, i.e., constituted at the left end in FIG. 1. The atomizing chamber 7 is comprised of a ceramic annular member 9 that fits to the inner peripheral portion of the combustion cylinder 11, an end plate 2 that fits to an end of the combustion cylinder 11, and a ceramic atomizing plate 8 which is located on the side that faces the combustion chamber 6 and which is equipped with many atomizing holes 3.

The annular member 9 and the atomizing plate 8 are constituted as a unitary structure to form a ceramic disc. The atomizing chamber 7 is filled with a fiber wick 10. A heating plug 15 is mounted on the end plate 2. The heating plug 15 consists of a heater bar 4 such as of a ceramic in which a heater coil 18 is buried. The heater bar 4 penetrates through the atomizing chamber 7, i.e., penetrates through the fiber wick and the atomizing plate 8, so that its end protrudes into the combustion chamber 6. The heater bar 4 is so constituted that a portion located in the atomizing chamber 7 has a low temperature and that an end portion protruded into the combustion chamber 6 has a high temperature. Therefore, the heating plug 15 exhibits the functions of both a glow plug for atomizing the liquid fuel into the gasified fuel and a glow plug for igniting the mixture consisting of the atomized fuel and the combustion air. The heating plug 15 has a terminal 19 at an end.

A fuel feed pipe 16 is connected to the annular member 9 which constitutes the atomizing chamber 7, and a fuel feed port 24 is formed in the fuel feed pipe 16. The fuel feed port is opened at an upper end of the atomizing chamber. Therefore, the liquid fuel supplied from a fuel feed pump 21 into the atomizing chamber 7 via the fuel feed pipe 16, flows down through the fiber wick 10 in the atomizing chamber 7, and is atomized into the gasified fuel reliably, quickly and smoothly as it flows down.

Figure 2:
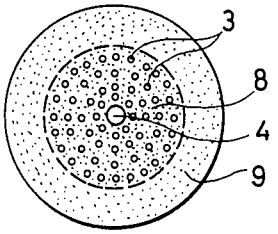
FIG. 2 is a plan view showing a ceramic disc which consists of an atomizing plate and an annular member.
Figure 3:
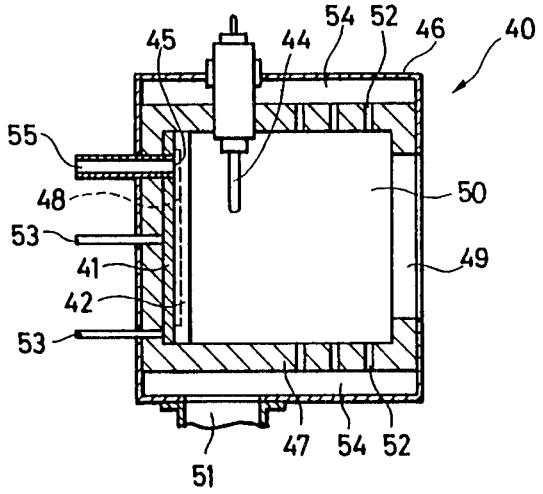
FIG. 3 is a section view showing a burner according to conventional art.
Figure 4:
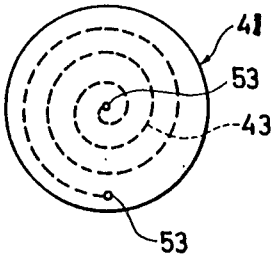
PRIOR ART FIG. 4
FIG. 4 is a plan view showing a fuel heating plate of FIG. 3.
Figure 5:
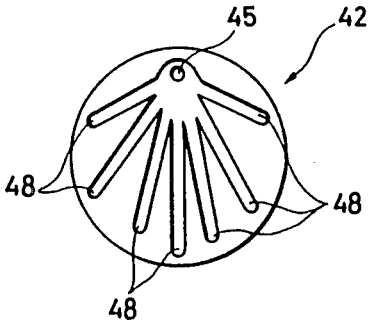
PRIOR ART FIG. 5
FIG. 5 is a rear view of an atomizing member of FIG. 3.

FIG. 2 is a plan view which illustrates a ceramic disc consisting of the annular member 9 and the atomizing plate 8 incorporated in the burner 1 of the present invention. The atomizing plate 8 of the ceramic disc has a heater bar 4 that protrudes from a hole at the center thereof, and has many atomizing holes 3 formed in the periphery thereof.

The burner 1 which is constructed as described above operates as mentioned below.

The electric power is supplied to the heater coil 18 of the heating plug 15 which serves as a glow plug for atomization and a glow plug for ignition, thereby to heat the heater bar 4, and the fuel feed pump 21 is driven to feed the liquid fuel to the atomizing chamber 7 through the fuel feed port 24 of the fuel feed pipe 16. The liquid fuel is introduced into the atomizing chamber 7 and is atomized as it flows down through the fiber wick 10 contained therein. The atomized fuel is then blown into the combustion chamber 6 from the atomizing holes 3. Here, the heater bar 4 of the heating plug 15 has a low temperature in the atomizing chamber 7, and its heat is conducted to the fiber wick 10. That is, the fiber wick 10 and the heater bar 4 are heated at such temperatures that are best suited for atomizing the liquid fuel so that it is atomized smoothly and quickly.

The combustion air, on the other hand, is sent from the air intake pipe 12, whirls through the air introducing path 25 defined between the outer housing 14 and the combustion cylinder 11, and is blown into the combustion chamber 6 from the air introducing holes 17 and 20. The air introducing holes 20 are formed on the upstream side of the combustion chamber 6 in a number smaller than the number of the air introducing holes 17, and supplies the combustion air in amounts adapted to igniting the atomized fuel. Since the heater bar 4 is heated at a high temperature at its end, the mixture consisting of the atomized fuel and the combustion air can be ignited reliably and quickly.

The atomized fuel is permitted to burn by the combustion air introduced through the air introducing holes 17. Here, since the air introducing holes 17 are formed in a large number on the downstream side of the combustion cylinder 11, the air is blown in large amounts into the combustion chamber 6, and the atomized fuel and the combustion air are mixed together homogeneously to produce a mixture that burns briskly and perfectly. The atomized fuel burns to form a combustion gas which will be sent to a heat exchanger (not shown) through a combustion gas blow-out pipe 22 from the combustion gas exhaust port 13 formed in the end wall 5 of the combustion cylinder 11.

In the foregoing was described in detail the burner of the present invention. The burner, however, need not necessarily be limited thereto only. For instance, though the combustion cylinder 11 was installed horizontally in FIG. 1, it may be installed vertically or in an inclined manner. In such a case, the position for mounting the fuel feed pipe should be suitably changed. In FIG. 1, furthermore, the atomizing plate has circular holes as atomizing holes which, however, may be replaced by oval holes, elongated holes or slits; i.e., no limitation is imposed on the shape of the holes.

Moreover, the air intake pipe may be mounted in the tangential direction relative to the outer housing. In this case, the whirl of the air is promoted through the air introducing path between the outer housing and the combustion cylinder, such that the air is uniformly introduced into the combustion chamber through the air introducing holes. The air intake pipe may further be mounted at any position on the outer housing without any limitation. Depending upon the mounting position, however, the amount of the air that passes through the duct and the air introducing holes varies, as a matter of course. Therefore, the mounting position should be suitably selected depending upon the size and shape of the burner, air introducing path and the like.

The air introducing holes and the atomizing holes may be suitably changed in regard to their numbers and positions.

In this invention, the heating plug was so formed as to penetrate through the centers of the fiber wick and the atomizing plate. The heating plug, however, need not necessarily be limited to penetrate through the centers, but may penetrate through the lower end or may extend at a slant from the lower end.

What is claimed is:

1. A burner comprising a combustion cylinder in which a combustion chamber is constituted;

a ceramic plate which constitutes an atomizing chamber at one end portion of said combustion cylinder and which is mounted on a wall at one end of said combustion cylinder, said ceramic plate having a plurality of holes;

a combustion gas exhaust port formed in the other end portion of said combustion cylinder;

a fiber wick contained in said atomizing chamber;

a heating plug which extends in the axial direction of said combustion cylinder through said atomizing chamber and said ceramic plate from the outside of the wall at one end of said combustion cylinder, a portion of the surface of said heating plug being exposed in said atomizing chamber and being brought into direct contact with said fiber wick contained in said atomizing chamber;

a fuel feed means for feeding a liquid fuel to said atomizing chamber in which said fiber wick is contained;

and a plurality of air introducing holes formed to penetrate through a wall of said combustion cylinder at a plurality of positions spaced apart from each other in the axial direction of said combustion cylinder.

2. A burner according to claim 1, wherein said heating plug is so constituted that a portion thereof located in said atomizing chamber has a low temperature and an end protruded into said combustion chamber has a high temperature.

3. A burner according to claim 1, wherein said heating plug is a heater bar composed of a ceramic material in which a heater coil is buried.

4. A burner according to claim 1, wherein an air introducing path is formed between said combustion cylinder and an outer cylinder which surrounds said combustion cylinder.

5. A burner according to claim 1, wherein said atomizing chamber, said combustion chamber and said combustion gas exhaust port are arranged in a lateral direction relative to each other.

6. A burner according to claim 5, wherein a fuel feed port of said fuel feed means is open at an upper end portion of said atomizing chamber.

* * * * *